US008281505B2

(12) United States Patent
Karlsson

(10) Patent No.: US 8,281,505 B2
(45) Date of Patent: Oct. 9, 2012

(54) WEAR PART FOR A BUCKET TO A LOADING OR DIGGING MACHINE, FASTENING UNIT THEREFORE AND WEAR PART SYSTEM, BUCKET AND LOADING OR DIGGING MACHINE

(75) Inventor: Kjell Karlsson, Degerfors (SE)

(73) Assignee: Atlas Copco Rock Drills AB, Orebro (SE)

( * ) Notice: Subject to any disclaimer, the term of this patent is extended or adjusted under 35 U.S.C. 154(b) by 162 days.

(21) Appl. No.: 12/735,145

(22) PCT Filed: Nov. 27, 2008

(86) PCT No.: PCT/SE2008/000664

§ 371 (c)(1), (2), (4) Date: Jun. 16, 2010

(87) PCT Pub. No.: WO2009/082317

PCT Pub. Date: Jul. 2, 2009

(65) Prior Publication Data

US 2011/0119964 A1 May 26, 2011

(30) Foreign Application Priority Data

Dec. 21, 2007 (SE) ..... 0702860

(51) Int. Cl.
*E02F 9/28* (2006.01)

(52) U.S. Cl. ..... 37/452; 37/446

(58) Field of Classification Search ..... 37/446, 37/452–460, 444; 172/701.1–701.3; 411/368, 411/147, 955, 544; 403/370, 374, 320, 409.1
See application file for complete search history.

(56) References Cited

U.S. PATENT DOCUMENTS

| | | | | |
|---|---|---|---|---|
| 943,775 | A | 12/1909 | Exton et al. | |
| 1,363,189 | A * | 12/1920 | Mulroney | 37/455 |
| 1,595,112 | A | 8/1926 | Mentzer | |
| 3,497,973 | A | 3/1970 | Campbell | |
| 3,762,079 | A * | 10/1973 | Lukavich et al. | 37/451 |
| 4,208,815 | A | 6/1980 | Yunker et al. | |
| 4,329,798 | A | 5/1982 | Edwards | |
| 4,671,000 | A | 6/1987 | Kim | |
| 4,748,754 | A | 6/1988 | Schwappach | |
| 5,165,487 | A | 11/1992 | Williams et al. | |

(Continued)

FOREIGN PATENT DOCUMENTS

| | | |
|---|---|---|
| WO | WO 95/01481 | 1/1995 |
| WO | WO 01/25551 A1 | 4/2001 |
| WO | WO 2007/129946 A1 | 11/2007 |

*Primary Examiner* — Robert Pezzuto
(74) *Attorney, Agent, or Firm* — Mark P. Stone

(57) ABSTRACT

A wear part for a bucket to a loading or digging machine, which bucket has at least one front edge plate with a forwardly directed engagement edge, and the wear part has a forward direction and a rearward direction and is provided with a hook portion for fixing of the wear part to the bucket, and the fastening portion has a spanning surface portion for co-operating in a contact surface area with a clamping surface portion on a fastening unit which is positionable through a hole in the front edge plate. The spanning surface portion extends at an angle against the forward direction such that, in use, when tightening the fastening unit, a force effecting the wear part in the rearward direction will occur. A fastening unit for the wear part and a wear part system, a bucket and a loading or digging machine are also provided.

20 Claims, 3 Drawing Sheets

U.S. PATENT DOCUMENTS 5,410,826 A 5/1995 Immel et al.
5,452,529 A 9/1995 Neuenfeldt et al.
5,564,206 A * 10/1996 Ruvang ..... 37/458
2003/0061744 A1 4/2003 Leslie et al.
2005/0172524 A1 8/2005 Grant
2007/0137071 A1 6/2007 McClanahan et al.

* cited by examiner

F
B
5
5'
5''
13
14
14'
14''
15
16
17
18
19
20
21
70
α
β
4

15
14
10
5

14
14'

14
14'

10
14
5

14
A
19
19'
14'

WEAR PART FOR A BUCKET TO A LOADING OR DIGGING MACHINE, FASTENING UNIT THEREFORE AND WEAR PART SYSTEM, BUCKET AND LOADING OR DIGGING MACHINE

FIELD OF THE INVENTION

The invention concerns a wear part for a bucket to a loading or digging machine. The invention also concerns a fastening unit and a wear part system, a bucket for a loading or digging machine and a loading or digging machine.

BACKGROUND OF THE INVENTION

Buckets with steel cutting edges in the form of front edge plates of hardened material are used for allowing penetration into material masses such as loosened ore, blast stone material, earth etc. to be lifted by the bucket for further transport. The cutting steel is often protected by a set of wear parts that can be fixed to the front edge of the bucket, for example through any form of locking element or in certain cases through welding.

The main task of the wear part is to protect parts of the bucket behind it from wear, allow easy penetration or masses in order to reduce wear and energy consumption and if possible shorten the cycle path for filling a bucket. A bucket provided with well functioning wear parts can also be used more aggressively as concerns penetration into material to be transported, which results in a time and costs reduction as concerns its use.

The use of wear parts on buckets also results in that the time periods between services of the buckets can be extended which is an economic advantage.

Through the patent publication US 2005/0172524 A1 is previously known a wear part intended to be fixed to a front edge plate of a loading bucket. The known wear part has a hook portion for the engagement with an engagement edge of the front edge plate and a fastening portion for fixing of the wear part to the bucket. The fastening portion has a hole for receiving and co-operation with a fastening unit which is intended to be applied through a hole also in the front edge plate. The described wear part functions generally well but requires, for obtaining adequate function, a relatively costly manufacturing process. As a further example of the background art, U.S. Pat. No. 5,425,529 can be mentioned.

AIM AND MOST IMPORTANT FEATURES OF THE INVENTION

The present invention aims to provide a wear part of the kind mentioned initially which avoids or at least mitigates the problems of the background art and in particularly so as to provide a more economical solution with at least maintained function.

These aims are obtained in respect of the wear part disclosed herein.

Hereby is achieved that the wear part can be safely fastened to the bucket and at the same time function within the normal tolerance range which will result from forming processes such as forging, without having to perform significant machining.

In spite of the normal relatively large tolerance deviations occurring during forming, a wear part according to the invention will be possible to fasten without play onto the bucket over a great tolerance range. This means that wear parts that deviates from each other as to form because of a deviating tolerances can be fastened without play onto the bucket. This is a great economic advantage since costly finishing precision machining such as grinding etc. can be avoided.

Freedom from play is further an essential aspect in respect of the forces that can occur in this connection, since play in fastenings would result in increased wear of the meeting parts and thereby jeopardise the connection geometry. Further, successive loosening of wear parts could result with resulting damage and failure risks as well as increased costs for service.

By, according to the invention, the tightening surface portion extends at an angle to said forward direction, wear parts can be safely fixed adequately to the bucket in spite of said tolerance deviations.

The tightening surface portion has preferably essentially linear extension in order to ensure good efficiency over a broad interval. In particular it is preferred that the tightening surface portion extends at an angle to the forward direction with an angle of about 35°-60° in order for good clamping effect to be achieved.

The wear part preferably provides a cutting edge extending essentially perpendicular to said forward direction, and the fastening portion preferably provides a plane contact surface portion for contact against the front edge plate.

The fastening unit according to the invention includes two parts that co-operate by way of a threaded connection, whereby the first part of the fastening unit is provided with a screw portion. The first part of the fastening unit is further provided with a fastening head, whereon a clamping surface portion is located for action against the wear part.

Further advantages are achieved in respect of further features of the invention which are subject to the dependent claims and which will be described below. Corresponding advantages are achieved through a fastening unit according to the invention, a wear part system including at least one wear part and a fastening unit according to the invention and a bucket provided with units from such a wear part system.

BRIEF DESCRIPTION OF DRAWINGS

The invention will now be described closer at the background of embodiments and with reference to the annexed drawings, wherein.

DESCRIPTION OF EMBODIMENTS

Figure 1A:
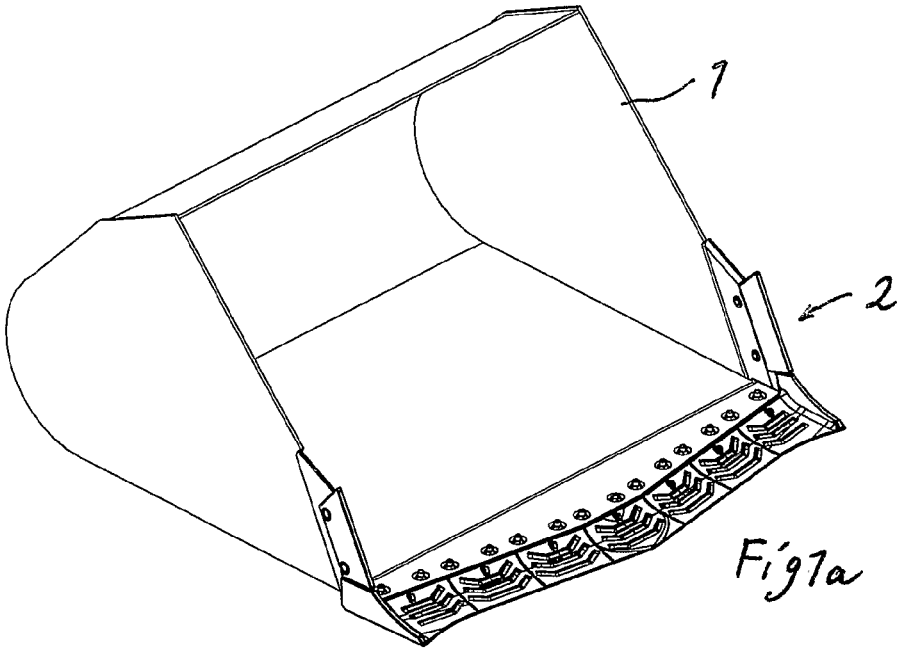
FIG. 1*a* shows diagrammatically a bucket for a loading machine including units from a wear part system according to the invention.
Figure 1B:
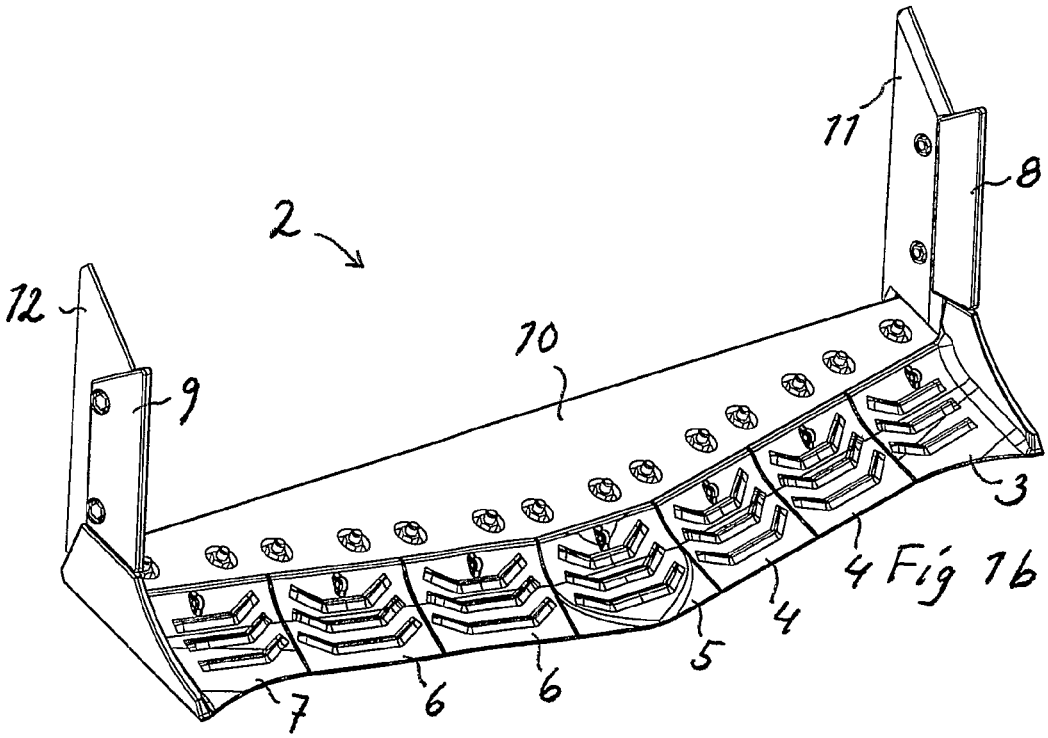
FIG. 1*b* shows the wear part system in FIG. 1*a* in a greater scale.

In FIG. 1*a*, reference numeral 1 indicates a bucket body for a loading machine which is intended for use for loading different kinds of masses such as ore and other blast stone material, earth etc. As complements to the bucket body 1 are shown in FIG. 1*b* in a larger scale different units from a wear part system 2, which includes wear parts 3-7 for fastening to a front edge in the form of a front edge plate 10, which together with side edges 11 and 12 are adapted for welding onto the bucket body 1 and form a front plate arrangement. The wear parts 2-7 form a cutting edge protection which covers the entire free edge of the front edge plate. FIG. 1*a* also shows wear parts 8 and 9 which are intended to cooperate with the side edges 11 and 12 completing the sides of the bucket body 1.

Figures 2, 3, 4A, 4B, 7A, 7B:
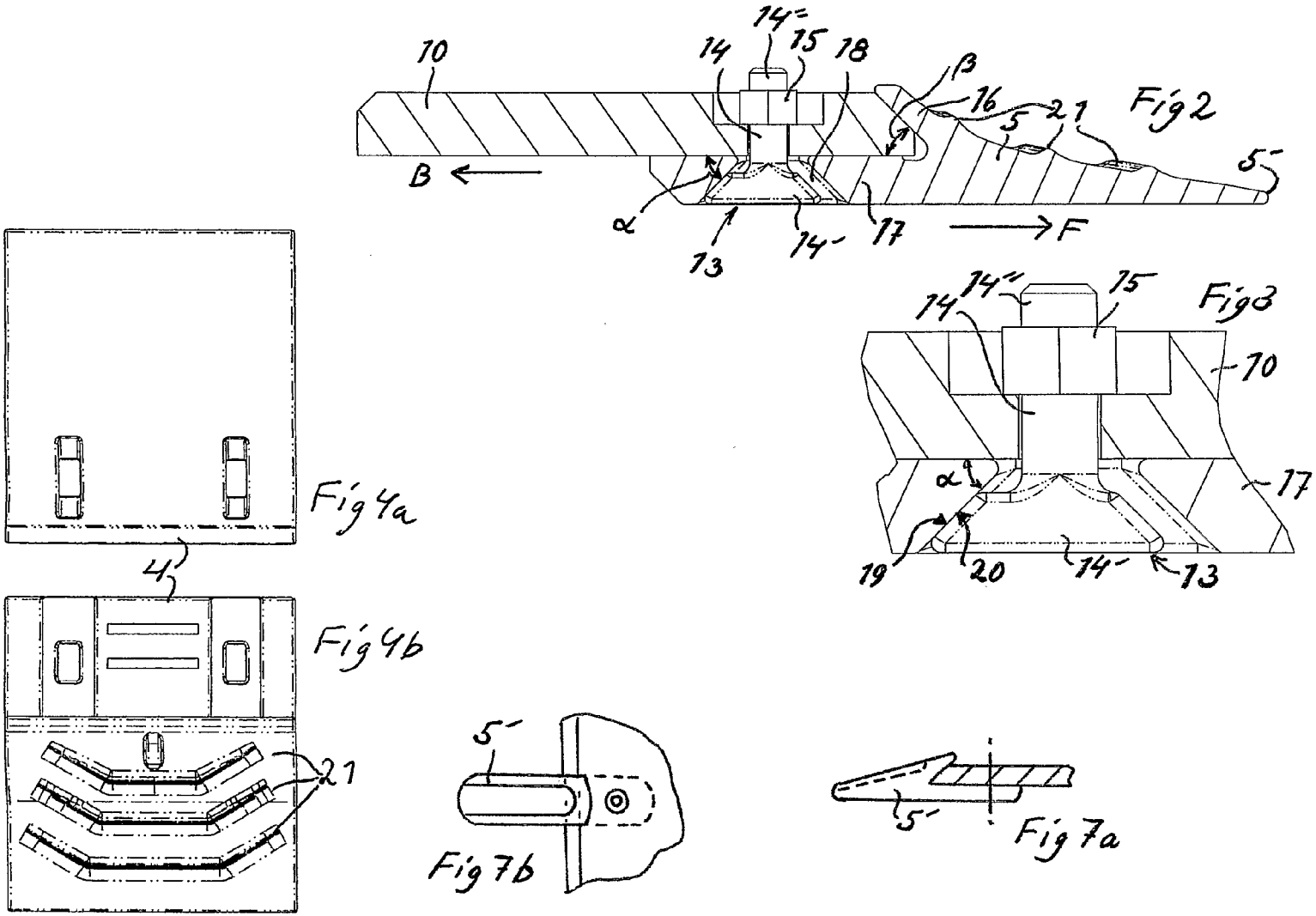
FIG. 2 shows a vertical section through part of the wear part system in FIG. 1 in a connected state.
FIG. 3 shows an enlargement of a detail in FIG. 2, FIGS. 4*a* and 4*b* show a wear part in views from above and from below.
FIGS. 7*a* and 7*b* show respectively an alternative wear part in views from the side and from above.

FIG. 2 shows the invention in more detail with a cutting edge on the front edge plate 10 directed to the right, and having an obliquely upwards, forwardly directed chamfering, which in turn forms an angle β to a horizontal plane through the front edge plate 10. The rear edge of the front edge plate 10, to the left on FIG. 2 is formed for welding to the bucket body 1 in FIG. 1.

The wear part 5, which is the central one of the group of wear parts 3 to 7 in FIG. 1, has a forward directed cutting edge 5' and a hook portion 16, which has an inner hook surface for lying against and for co-operation with said chamfering on the front edge plate 10. F indicates the forward direction of the wear part 5.

The hook portion 16 is preferably dimensioned such that its upper edge is just about in line of at least not essentially above the upper surface of the front edge plate 10. This gives several advantages, for example easier loading of material and easier penetration into a pile of masses. Further, which is essential, emptying of the bucket is facilitated, since no portion of the wear part 5 extends above the front edge plate 10 and thereby could prevent loaded material from sliding out from the bucket during unloading.

The wear part 5 is provided with a rear fastening portion 17, which has a planar contact surface for contact against the underside of the front edge plate 10.

The fastening portion 17 has a recess for a fastening unit 13, which fastening unit, as is shown in the Figure, penetrates a hole in the front edge plate 10. The fastening unit 13 has a first portion in the form of a fastening screw 14 with a fastening head 14' and a second portion in the form of a nut 15, which is received in a recess in the front edge plate 10 and co-operates with a screw portion 14" of the fastening screw 14. In use, the nut 15 and the screw portion 14" are received in said recess in the front edge plate 10.

The fastening head 14' is received in a recess in the fastening portion 17 to the extend that the fastening head 14' has an angle portion with the angle α which cooperates with a corresponding angle portion on the fastening portion 17. Tightening of the fastening unit 13 by tensioning the nut 15, results in that a clamping force is produced in the contact between the fastening unit 13 and the recess in the fastening portion 17, such that the wear part 5 is subjected to a spanning force in the rearward direction B, wherein the wear part 5 is safely tightened firmly against the front edge plate 10.

In FIG. 3 is shown in more detail the fastening head 14' with its side edge having a clamping surface portion 19 which extends with said angle α to a horizontal plane.

With 20 is indicated a tightening surface portion positioned in the above mention recess in the fastening portion 17, which tensioning surface portion 20 is formed with an angle such that when tightening the fastening unit 13 the wear part 5 experiences tensioning in the backward direction as is indicated above.

18 indicate in FIGS. 2 and 3 a free space which is provided in order to ensure that sufficient tensioning of the wear part 5 against the front edge plate 10 front edge will occur when tightening the fastening unit 13, without the possibility of contact to occur on the other side of the fastening unit 13, which could prevent the obtaining of a sufficient spanning force in the backward direction.

FIG. 3 shows the fastening unit 13 in more detail with the fastening head 14', the side edge of which having a side edge 19 extending at an angle α against a horizontal plane, which extends essentially perpendicular to the screw portion 14". The side edge 19 abuts in the using position against a spanning surface portion 20 on the fastening portion 17.

In FIGS. 4*a* and 4*b* is shown a wear part 4 seen from above and from below, respectively. The underside is, as is shown, essentially even, whereas on the upper side there are provided a number of ridges 21, which with some partial angle deviations extend essentially perpendicular to the F direction.

Figures 5A, 5B, 5C, 6A, 6B:
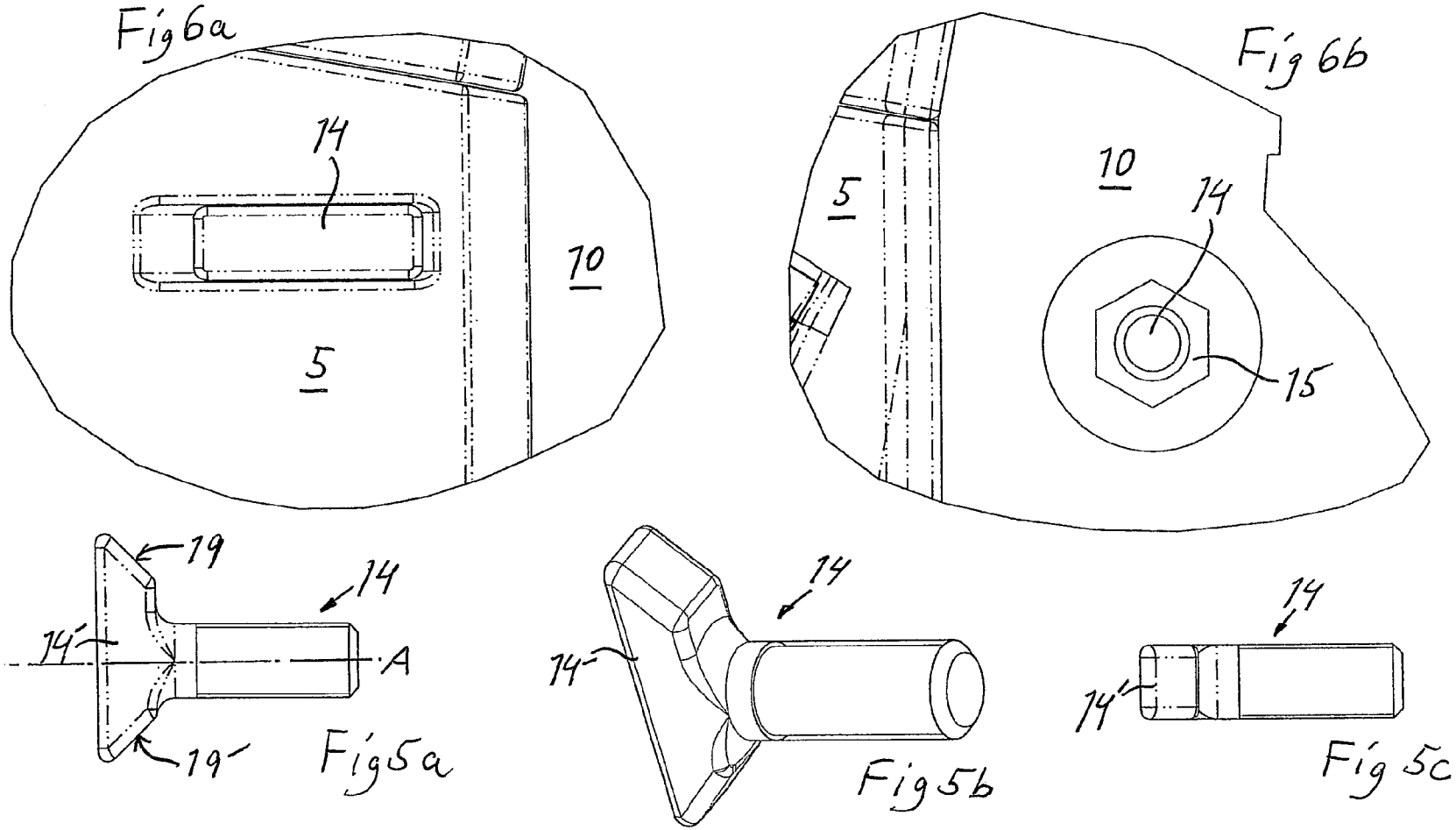
FIG. 5*a-c* show a fastening unit for use in respect of the invention in different views.
FIGS. 6*a* and 6*b* show the subject of FIG. 2 seen from below and from above.

FIG. 5*a* shows the fastening screw 14 in a plane view, whereby is shown that in this embodiment it is not symmetrical and that the fastening head 14' protrudes differently on the different sides of its two opposite clamping surface portions 19 and 19', whereof one is intended to engage a spanning surface portion on a wear part. The fastening screw 14 is thereby turnable and the deviation in protrusion seen from an axis A being a symmetry axis for the fastening screw portion, could be measured such that for example greater tolerance deviations of the associated parts can be compensated for. This lack of symmetry also has the advantage that the fastening screw can be used for somewhat differently manufactured wear parts, by the fastening screw being possible to turn such as to obtain the best clamping effect in the particular case.

FIG. 5*b* shows the fastening screw 14 in a perspective view.

FIG. 5*c* shows that the fastening head 14' of the fastening screw 14 is flat on its sides, which also corresponds to the form of a recess in the wear part 5 in order to prevent rotational of the fastening unit 3 during its tightening. It is also shown that the flattened fastening head 14' has a width essentially corresponding to the diameter of the screw portion 14".

In FIGS. 6*a* and 6*b*, the wear part 5 is shown in its rear portions as seen from below and from above, respectively in FIG. 2.

The invention can be modified within the scope of the following claims and the wear part 5 can be constructed differently with different angle and dimensions in the forward direction as well as in the sideward direction. It is preferred that the angles α and β are between about 35° and 60°. It is most preferred that the angles α and β are between about 40° and 55° and in the shown example both angles α and β are about 45°. The angles α and β do not have to be the same and can be chosen independently from each other for the desired effect.

As is shown from FIGS. 7*a* and 7*b*, the wear part can also be a digging tooth 5' and it can be constructed such that it together with other digging teeth do not cover a front edge of a bucket or the like. This can also be the case for wear parts for loading buckets. The fastening unit 13 can be constructed differently and other engagement means than screw threads can come into question also if this is not preferred. It is, however, required that the fastening unit 13 can be strongly and safely tightened against a corresponding surface on the wear part.

As a different from the shown example of a fastening unit the fastening head can be symmetrical, which can be an advantage since it can be turned at a choice. It is not excluded that only one side of the fastening head is provided with an angle edge 19. The other side of the fastening head 14' can be straight and generally follow the axial extension of one side of the screw portion 14".

The wear part 5 according to the invention can be manufactured with conventional forging techniques and does not have to be followed by precisions machining thanks to the invention for reaching tighter tolerances. Some normal grading work etc. is however, normally to be performed.

The fastening unit 13 can be manufactured in different ways but can preferably be forged as concerns the first part, the fastening screw 14. A wear part 5 can be fixed by means of one fastening unit or two or even more fastening units. It is preferred that the spanning surface portion 20 and the clamping surface portion 19 extend linearly but it is not excluded that they can have curved configuration.

The inventive solution results, besides the advantages indicated above, also in the advantage that the important forces occurring when using a bucket of the intended kind to a great extent will be taken up by the construction without having to strain the fastening unit. Forces directed downwardly and rearwardly onto the wear part during loading etc. will thereby essentially be received through the contact between the wear part and the front edge plate and bucket whereas the fastening unit 13 will be essentially unaffected by such forces.

The invention claimed is:

1. Wear part for a bucket to a loading or digging machine, said bucket being provided with at least one front edge plate with a forwardly directed engagement edge, wherein the wear part has a forward direction and a rearward direction and a fastening portion for fixing of the wear part to the bucket, wherein the fastening portion has a spanning surface portion for co-operating in a contact surface area with a clamping surface portion on a fastening unit, said fastening unit being positionable and tightenable through a hole in said front edge plate, and wherein the spanning surface portion is located in a recess in the fastening portion and extends at a first angle against said forward direction such that, in use, when tightening said fastening unit a force effecting the wear part in the rearward direction will occur, and wherein the wear part is provided with means for engagement with said engagement edge, wherein said means for engagement with said engagement edge is a hook portion, the hook portion includes an inner hook surface for lying against and for co-operation, in operation, with an obliquely upwards, forwardly directed chamfering on the edge plate, said chamfering and thereby the inner hook portion forming a second angle of 35°-60° to a horizontal plane through the front edge plate, and the spanning surface portion extends such that the first angle against said forward direction is 35°-60°.

2. Wear part according to claim 1, wherein the spanning surface portion has essentially linear extension.

3. Wear part according to claim 1, said wear part has a cutting edge which extends essentially perpendicular to said forward direction.

4. Wear part according to claim 1, wherein the fastening portion has a planar contact surface portion for contacting the front edge plate.

5. Wear part system including at least one wear part according to claim 1 and at least one said fastening unit, said fastening unit including a first part thereof acting against the wear part and a second part co-operating with said first part through a threaded connection, wherein the first part of the fastening unit is provided with a screw portion and with a fastening head, the fastening head of the first part of the fastening unit being provided with a first said clamping surface portion and a second said clamping surface portion, wherein the first and second clamping surface portions have different protrusions relative to an axis through the first part of the fastening unit.

6. Wear part system according to claim 5 wherein said front edge plate includes a front plate arrangement for receiving at least one said wear part and at least one said fastening unit, said front plate arrangement being constructed for welding to said bucket of said loading or digging machine.

7. Bucket for a loading or digging machine including a wear part system according to claim 5.

8. Loading or digging machine including a bucket according to claim 7.

9. Wear part according to claim 2, wherein said wear part has a cutting edge which extends essentially perpendicular to said forward direction.

10. Wear part according to claim 2, wherein the fastening portion has a planar contact surface portion for contacting the front edge plate.

11. Wear part according to claim 3, wherein the fastening portion has a planar contact surface portion for contacting the front edge plate.

12. Wear part system including at least one wear part according to claim 2 and at least one said fastening unit, said fastening unit including a first part thereof acting against the wear part and a second part co-operating with said first part through a threaded connection, wherein the first part of the fastening unit is provided with a screw portion and with a fastening head, the fastening head of the first part of the fastening unit being provided with a first said clamping surface portion and a second said clamping surface portion, wherein the first and second clamping surface portions have different protrusions relative to an axis through the first part of the fastening unit.

13. Wear part system including at least one wear part according to claim 3 and at least one said fastening unit, said fastening unit including a first part thereof acting against the wear part and a second part co-operating with said first part through a threaded connection, wherein the first part of the fastening unit is provided with a screw portion and with a fastening head, the fastening head of the first part of the fastening unit being provided with a first said clamping surface portion and a second said clamping surface portion, wherein the first and second clamping surface portions have different protrusions relative to an axis through the first part of the fastening unit.

14. Wear part system including at least one wear part according to claim 4 and at least one said fastening unit, said fastening unit including a first part thereof acting against the wear part and a second part co-operating with said first part through a threaded connection, wherein the first part of the fastening unit is provided with a screw portion and with a fastening head, the fastening head of the first part of the fastening unit being provided with a first said clamping surface portion and a second said clamping surface portion, wherein the first and second clamping surface portions have different protrusions relative to an axis through the first part of the fastening unit.

15. Wear part system according to claim 2 wherein said front edge plate includes a front plate arrangement for receiving at least one said wear part and at least one fastening unit, said front plate arrangement being constructed for welding to said bucket of said loading or digging machine.

16. Wear part system according to claim 3 wherein said front edge plate includes a front plate arrangement for receiving at least one said wear part and at least one fastening unit, said front plate arrangement being constructed for welding to said bucket of said loading or digging machine.

17. Wear part system according to claim 4 wherein said front edge plate includes a front plate arrangement for receiving at least one said wear part and at least one fastening unit, said front plate arrangement being constructed for welding to said bucket of said loading or digging machine.

18. Bucket for a loading or digging machine including a wear part system according to claim 6.

19. Fastening unit for a wear part to a bucket of a loading or digging machine, said wear part having a forward direction, wherein the fastening unit is positionable and tightenable through a hole in a front edge plate of said bucket, and wherein the fastening unit includes clamping surface portions portion on a first part thereof for acting against the wear part, wherein the clamping surface portions extend at a first angle against said forward direction such that in use during tensioning of said fastening unit a force effecting the wear part in a rearward direction will occur, wherein the fastening unit includes a second part co-operating with said first part through a threaded connection, wherein the first part of the fastening unit is provided with a screw portion and with a fastening head whereon the clamping surface portions are positioned, wherein the first part of the fastening unit is provided with a first and a second of said clamping surface portions, wherein said first and second clamping surface portions have different protrusions relative to an axis through the first part of the fastening unit.

20. Wear part system including at least one fastening unit according to claim 19.

* * * * *

UNITED STATES PATENT AND TRADEMARK OFFICE

CERTIFICATE OF CORRECTION

PATENT NO. : 8,281,505 B2
APPLICATION NO. : 12/735145
DATED : October 9, 2012
INVENTOR(S) : Kjell Karlsson It is certified that error appears in the above-identified patent and that said Letters Patent is hereby corrected as shown below:

Column 7, Line 8 (Claim 19, Line 6): Delete "portion".

Signed and Sealed this
Twentieth Day of November, 2012

David J. Kappos

David J. Kappos
*Director of the United States Patent and Trademark Office*